US008438761B2

(12) United States Patent
Nielsen et al.

(10) Patent No.: US 8,438,761 B2
(45) Date of Patent: May 14, 2013

(54) METHOD IN THE OPERATION OF SPREADER CLAMPS

(75) Inventors: Steen Nielsen, Rønne (DK); Kim Cordua, Rønne (DK); Henrik Andersen, Gudhjem (DK); Niels Peter Madsen, Rønne (DK)

(73) Assignee: Jensen Denmark A/S, Ronne (DK)

( * ) Notice: Subject to any disclaimer, the term of this patent is extended or adjusted under 35 U.S.C. 154(b) by 497 days.

(21) Appl. No.: 12/601,242

(22) PCT Filed: May 23, 2008

(86) PCT No.: PCT/DK2008/000195
§ 371 (c)(1),
(2), (4) Date: May 25, 2010

(87) PCT Pub. No.: WO2008/141649
PCT Pub. Date: Nov. 27, 2008

(65) Prior Publication Data

US 2010/0242318 A1 Sep. 30, 2010

(30) Foreign Application Priority Data

May 23, 2007 (DK) ..... 2007 00758

(51) Int. Cl.
*D06F 67/04* (2006.01)
*D06F 89/00* (2006.01)

(52) U.S. Cl.
USPC ..... 38/143

(58) Field of Classification Search ..... 38/143
See application file for complete search history.

(56) References Cited

U.S. PATENT DOCUMENTS 1,997,267 A * 4/1935 Remington ..... 38/2
3,664,046 A * 5/1972 Thompson ..... 38/143

(Continued)

FOREIGN PATENT DOCUMENTS

DE 42 02 380 C2 1/1993
EP 0 548 797 B1 6/1993

(Continued)

OTHER PUBLICATIONS

International Search Report from European Patent Office for International Application No PCT/DK2008/000195, Mailed Sep. 22, 2008.

(Continued)

*Primary Examiner* — Ismael Izaguirre
(74) *Attorney, Agent, or Firm* — Finnegan Henderson Farabow Garrett & Dunner LLP

(57) ABSTRACT

A method for operating two spreader clamps for receiving and holding in pairs pieces of cloth and for spreading out the pieces of cloth before they are delivered to a conveyor, that includes selecting whether the two spreader clamps first spread a piece of cloth about one of two outer centerlines of the conveyor for small-sized pieces of cloth or about a first centerline for large-sized pieces of cloth, feeding a piece of cloth to the spreader clamps, moving the two spreader clamps so as to be situated in relation to the centerline selected, initiating movement of the spreader clamps to either side of the centerline selected to spread the piece of cloth and ascertaining during the spreading about the centerline selected if the piece of cloth is a large-sized piece or a small-sized piece, wherein if an outer centerline is selected and it is ascertained that a piece is a large-sized piece of cloth, moving the two spreader clamps so that the piece of cloth is spread about the first centerline and if the first centerline is selected and it is ascertained that the piece of cloth is a small-sized piece of cloth, moving the two spreader clamps so that the piece of cloth is spread about one of the outer centerlines.

7 Claims, 7 Drawing Sheets

U.S. PATENT DOCUMENTS

| | | | | | |
|---|---|---|---|---|---|
| 3,756,588 | A | * | 9/1973 | Gerstenberger | 38/143 |
| 4,050,173 | A | * | 9/1977 | Olsen | 38/143 |
| 4,106,227 | A | * | 8/1978 | Allen et al. | 38/143 |
| 5,815,963 | A | * | 10/1998 | Rauch et al. | 38/143 |
| 6,141,893 | A | * | 11/2000 | McCabe | 38/143 |
| 2007/0000158 | A1 | | 1/2007 | Baboz et al. | |

FOREIGN PATENT DOCUMENTS

| | | | |
|---|---|---|---|
| EP | 0554 205 | B1 | 8/1993 |
| EP | 0794 279 | B1 | 9/1997 |
| EP | 0 942 428 | B1 | 9/1999 |
| EP | 0 982 428 | B1 | 3/2000 |
| EP | 1 683 908 | A1 | 7/2006 |
| EP | 1 820 894 | A1 | 8/2007 |
| WO | WO 2005/035860 | A1 | 4/2005 |
| WO | WO 2007/134601 | A1 | 11/2007 |

OTHER PUBLICATIONS

International-Type Search Report from Swedish Patent Office for Application No. ITS/DK07/00006, Mailed Feb. 20, 2008.

* cited by examiner

METHOD IN THE OPERATION OF SPREADER CLAMPS

The invention relates to a method in the operation of at least two spreader clamps for receiving in pairs pieces of cloth from at least one charger station and for spreading the pieces of cloth prior to them being fed to a conveyor which, on the one hand, has a centreline for a large-sized piece of cloth and, on the other hand, has several centre lines for small-sized pieces of cloth.

In practice, said different centrelines are related to what is referred to as one- and two-lane operation. This means that, due to the limiting working width of the laundry apparatus, it is possible to advance only either one single wide piece of cloth or several more narrowly sized pieces of cloth next to each other. The number of charger stations before the spreader clamps is, for practical uses, three or four to the effect that two operators are able to feed pieces of cloth via a charger station to the spreader clamps. To enable the most efficient control of the clamps and also to obtain the highest productivity, operation could be based on the width of each individual piece of cloth being known in advance; either by a sorting procedure being carried out before the charger station or by the length being measured before or in the connection with the spreading.

Several different ways of calculating or measuring the width of the pieces of cloth are known.

For instance, DE 4202380 discloses a method by which it is possible to calculate the length of the upper edge of the piece of cloth by means of distances in a triangular figure.

EP 548797 teaches another method of measuring the length of the upper edge prior to the spreader clamps pulling out the piece of cloth.

EP 982 428 discloses a method by which the length of the upper edge of the piece of cloth is ascertained in advance, following which the pieces of cloth are stored before they are conveyed to the spreader clamps.

The invention lends itself for use in particular with the so-called front-loader apparatuses where one or more charger stations are provided within the working width of the roller path. This is due to the fact that, in case of front-loader apparatuses, one does not know in advance in which direction the spreader clamps are to travel. Obviously, greater capacity can be obtained when knowing the dimension of the piece of cloth in advance, but this would presuppose that such information is fed to the apparatus in advance, or that the apparatus is equipped with complex systems for measurement, eg as it is known from EP 0 548 797 B1.

It is the object of the invention to provide a method for automatic 1- or 2-lane operation, where one does not have to know or measure the dimension of the pieces of cloth before choosing whether the pieces of cloth are to be spread for 1- or 2-lane feeding.

This object is accomplished in that the method is exercised such that it is chosen for a batch of pieces of cloth whether the spreader clamps are first to spread a piece of cloth centred about a centreline for small-sized pieces of cloth or are first to spread a piece of cloth centred about the centreline for large-sized pieces of cloth.

This can also be expressed such that, based on an evaluation of the distribution of 1- and 2-lane operation of the pieces of cloth to be treated, the operator selects whether the apparatus is to feed for 1-lane or 2-lane operation. When that selection is made, the apparatus will always initiate the spreading based on that selection and in those cases where it is detected during the spreading procedure that the selection was wrong, switching is made to the other spreading form as will appear from claims 2 and 3.

The invention is based on the discovery that it is often relatively easy to ascertain whether a batch of pieces of cloth predominantly contains a majority of large or a majority of small pieces of cloth; and that by use of the invention a surprisingly high capacity and utilisation of the roller path are accomplished without knowing in advance whether the pieces of cloth are fit for 1- or 2-lane operation, ie without having first to measure them.

It is noted that the invention is not limited to precisely a charger station, and nor is it limited to the provision of only at least two spreader clamps. For instance, one could imagine embodiments with four charger stations and two pairs of spreader clamps.

Detection whether the piece of cloth is actually a small- or a large-sized piece of cloth can be performed in a variety of ways when the piece of cloth is essentially spread out, eg by ascertaining whether the spreader carriage has or is driven past the middle, or whether the spreader carriages have exceeded mutual min/max distances when the piece of cloth is close to being spread. One may also detect the distance between the spreader clamps when the spreading force exceeds a certain level.

Such measurement may be based eg on the power supply of the drive engines or a measurement of the force transmitted from the drive means to the spreader clamps.

According to a preferred embodiment three spreader clamps are used that are preferably operated such that a pair of spreader clamps comprises the middle spreader clamp and comprises the one of the outer spreader clamps which is closest to the charger station from which the piece of cloth is to be received. That operation of the spreader clamps entails that the total distance traveled by them is reduced which reduces the throughput time of the pieces of cloth.

The invention will be explained in further detail by the following description of a number of embodiments, reference being made to the drawing, wherein FIG. 1 is a perspective view of an apparatus used for exercising the method according to the invention;

Figure 1:
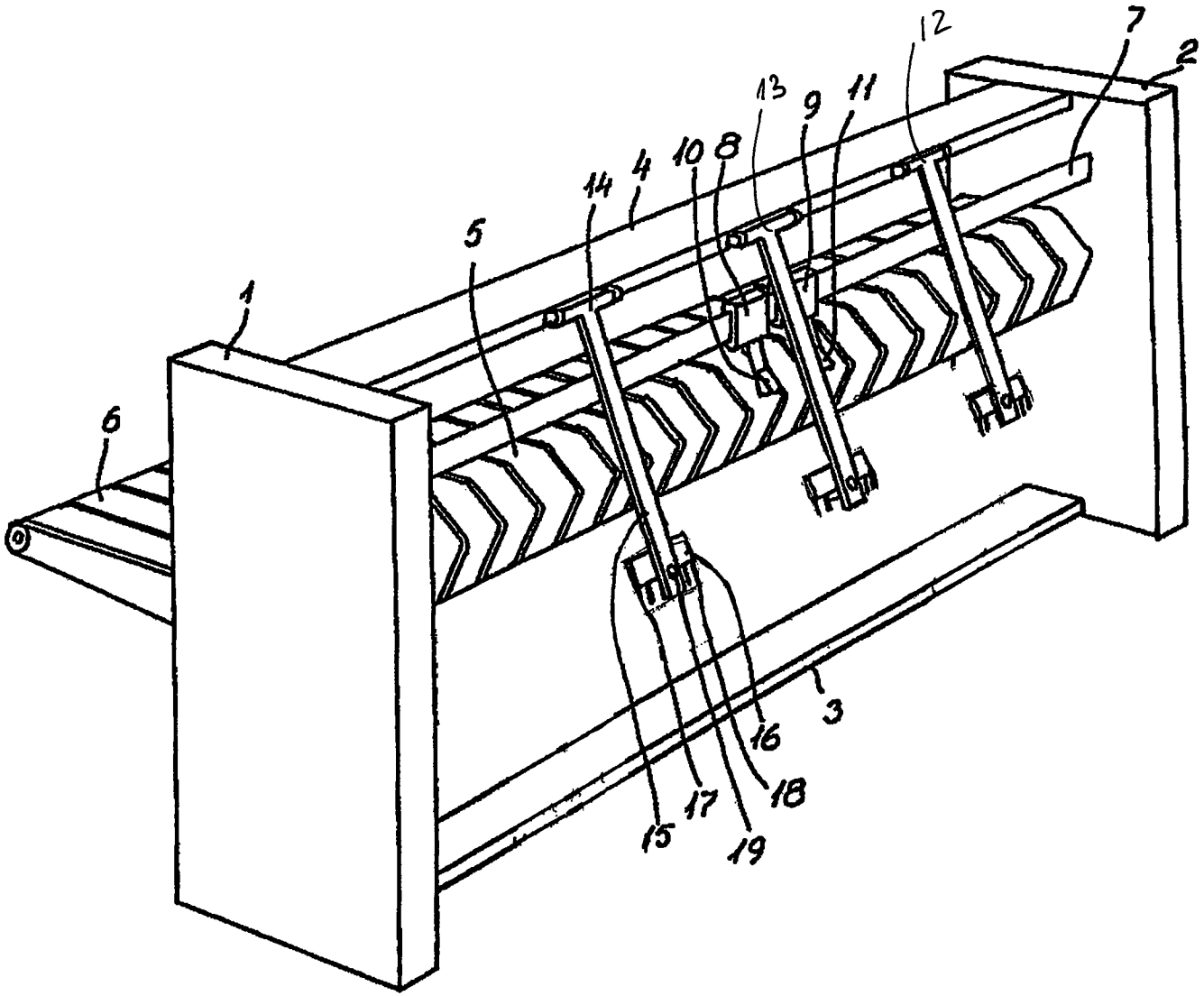

FIG. 1 shows an apparatus for use in laundries where the apparatus is configured for receiving the moist, clean laundry and is configured for spreading the pieces of cloth and convey it to a rotary ironer. The apparatus comprises side brackets 1 and 2 and a bottom and a top piece, 3 and 4, respectively. On the top piece 4 three charger stations 12, 13, and 14 are mounted that all have, at their bottom end, two pairs of conveyor clamps 16 and 17 (for the charger station 14). Between the side brackets 1 and 2 a rail 7 is extending that carries a pair of carriages 8 and 9 that can be moved separately along the entire length of the rail 7 by means of not shown drive means and each of which has a spreader clamp 10 and 11, respectively. Moreover, the apparatus comprises a conveyor belt 6.

The apparatus shown in FIG. 1 works such that an operator, eg at the charger station 14, arranges two corners of a piece of cloth in each their pair of conveyor clamps 16, 17 and activates a button 19, following which the conveyor clamps are moved upwards in a position in which the spreader clamps 10 and 11 are able to take over the piece of cloth. The spreader clamps are moved towards the conveyor clamps, and when the piece of cloth has been taken over by the spreader clamps 10, 11, it is moved such that the piece of cloth is spread out following which it is delivered in spread-out state onto the roller conveyor.

The invention relates to control of the spreader clamps. Initially it is noted that it is a well-known problem to operate the spreader clamps as efficiently as possible, in particular when the apparatus operates with both 1- and 2-lane operation. Thereby it is understood that some pieces of cloth are so big that they require the entire working width of the apparatus, while other pieces of cloth are sufficiently small to allow that two pieces of cloth may sit next to each other in the width of the apparatus. Thereby the subsequent rotary ironer is used more to advantage.

In the following description the designation K1, K2 . . . will designate spreader clamps; C1, C2 . . . will designate centrelines for roller paths, ie the possible lanes on the conveyor belt 6; while L1, L2 . . . will designate charger stations before the apparatus.

Figure 2:
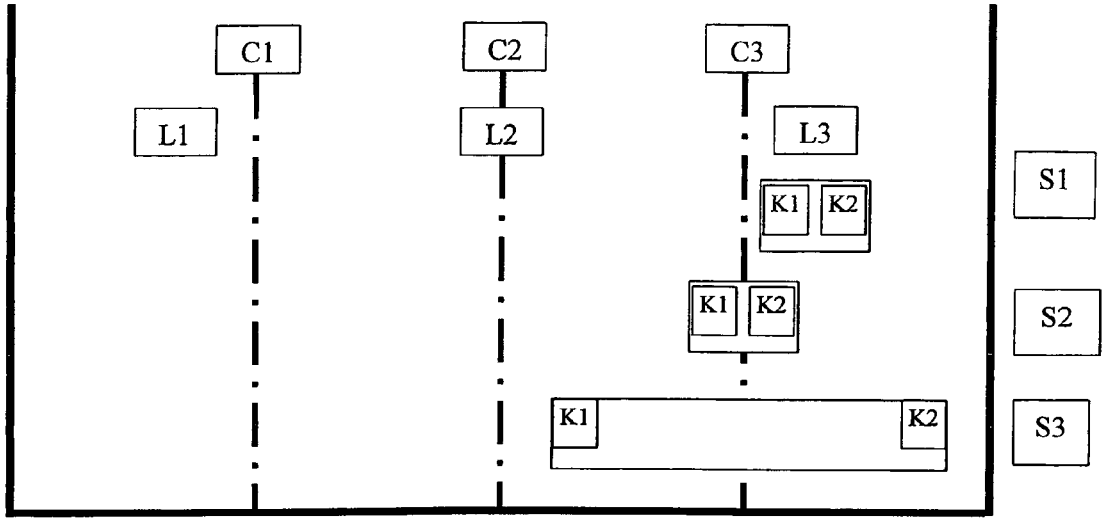
FIGS. 2 and 3 show examples of exercising the invention by means of an apparatus as shown in FIG. 1.

Relative to this, C1 and C3 of FIG. 2 designate the centreline for relatively small pieces of cloth, ie smaller than half of the working width of the apparatus, while C2 designates the centreline for pieces of cloth of a comparatively large width, ie pieces of cloth that are larger than half the working width of the apparatus.

Figure 3:
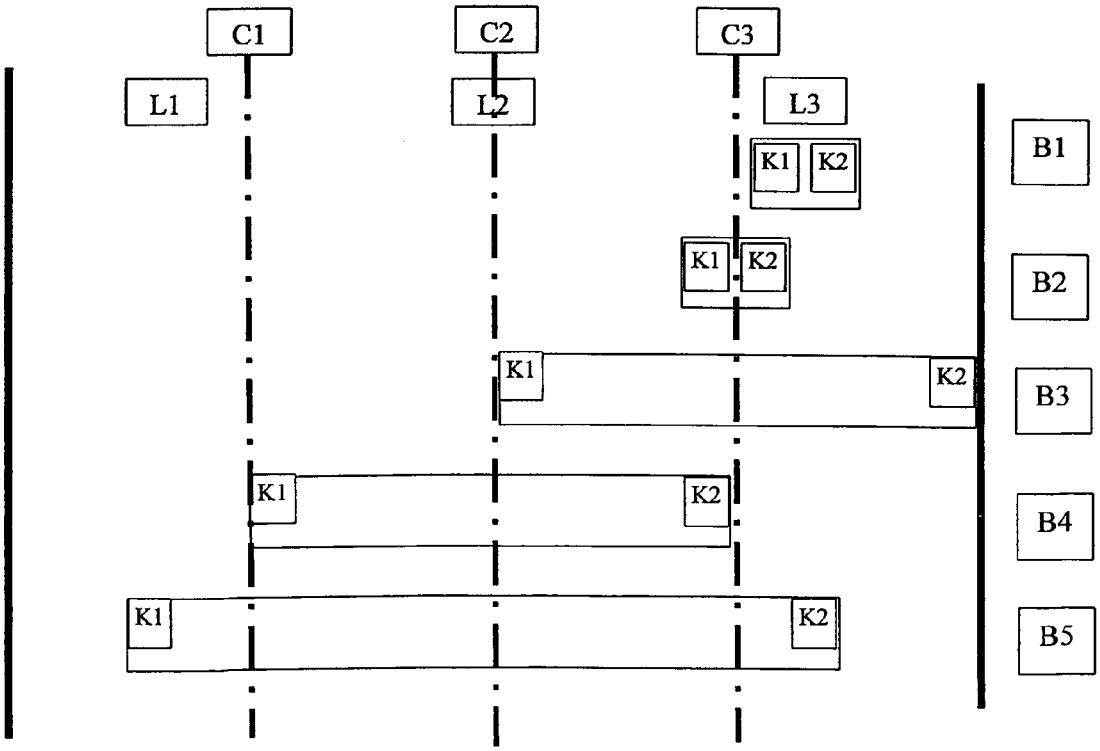

FIGS. 2 and 3 show a number of work phases S1-S3 and B1-B5, respectively, for small-sized and large-sized pieces of cloth, where the figures are, from a time point of view, read from the top of the figure. When the operator has arranged a pair of corners of a piece of cloth in the conveyor clamps 16, 17 and has activated the button 19, the conveyor clamps start to move upwards, while the spreader clamps 10, 11 move to a position in front of the conveyor clamps, see phase S1.

According to the invention, the operator performs an assessment whether the batch of pieces of cloth to be treated predominantly contains large-sized or small-sized pieces of cloth. It is assumed in the following, ie both in FIGS. 2 and 3, that the batch of pieces of cloth predominantly contains small-sized pieces of cloth and, under that assumption, the spreader clamps 10, 11 will first travel to and be positioned about the most proximate one of the centrelines C1 or C3 when small-sized pieces of cloth are concerned, see S2. During the time phase S3, the piece of cloth is spread out and ready to be handed over to the conveyor 6 as it turned out that it was indeed a small-sized piece of cloth. This is ascertained eg by seeing whether the spreader carriage has or is driven past the middle or whether the spreader carriages have exceeded mutual min/max distance when the piece of cloth is close to being spread. One may also detect the distance between the spreader clamps when the spreading force exceeds a certain level.

FIG. 3 shows a scenario in which the piece of cloth is not spread when the spreader clamp K1 has come too close to or has passed the centreline C2. B1 and B2 correspond to S1 and S2 in FIG. 2, but during the time phase B3 it is ascertained that the piece of cloth is a large-sized piece of cloth. In accordance with the invention, the spreader clamps K1, K2 will then be centred about the centreline C2 when relatively large-sized pieces of cloth are concerned, as shown in the time phase B4, following which the spreader clamps K1, K2 spread out the pieces of cloth completely as shown during time phase B5.

If, at the beginning, the operator had alternatively ascertained that the batch of the piece of cloth had predominantly contained large-sized pieces of cloth, the spreader clamps K1 and K2 would all the time first move to be situated about the centreline C2 when large-sized pieces of cloth are concerned, and if, during the spreading out of such piece of cloth, it should turn out that a small-sized piece of cloth was concerned, the spreader clamps will move to be situated about one of centrelines C1 or C3 and not transfer the piece of cloth to the conveyor 6 until then.

In connection with the phase S2 (FIG. 2) and B2 (FIG. 3) it has been shown that clamps K1 and K2 are first moved together to lie symmetrically about C3 before the clamps are moved away from each other (S3 and B3, respectively). The invention also comprises that phases S2 and B2 could be omitted, and that clamp K2 could immediately be moved slightly to the right to the position shown by S3 or B3, while the clamp K1 is simultaneously moved to the left to the position shown by S3 and B3. Those options for operating the clamps are relevant to all embodiments of the invention.

Figure 4:
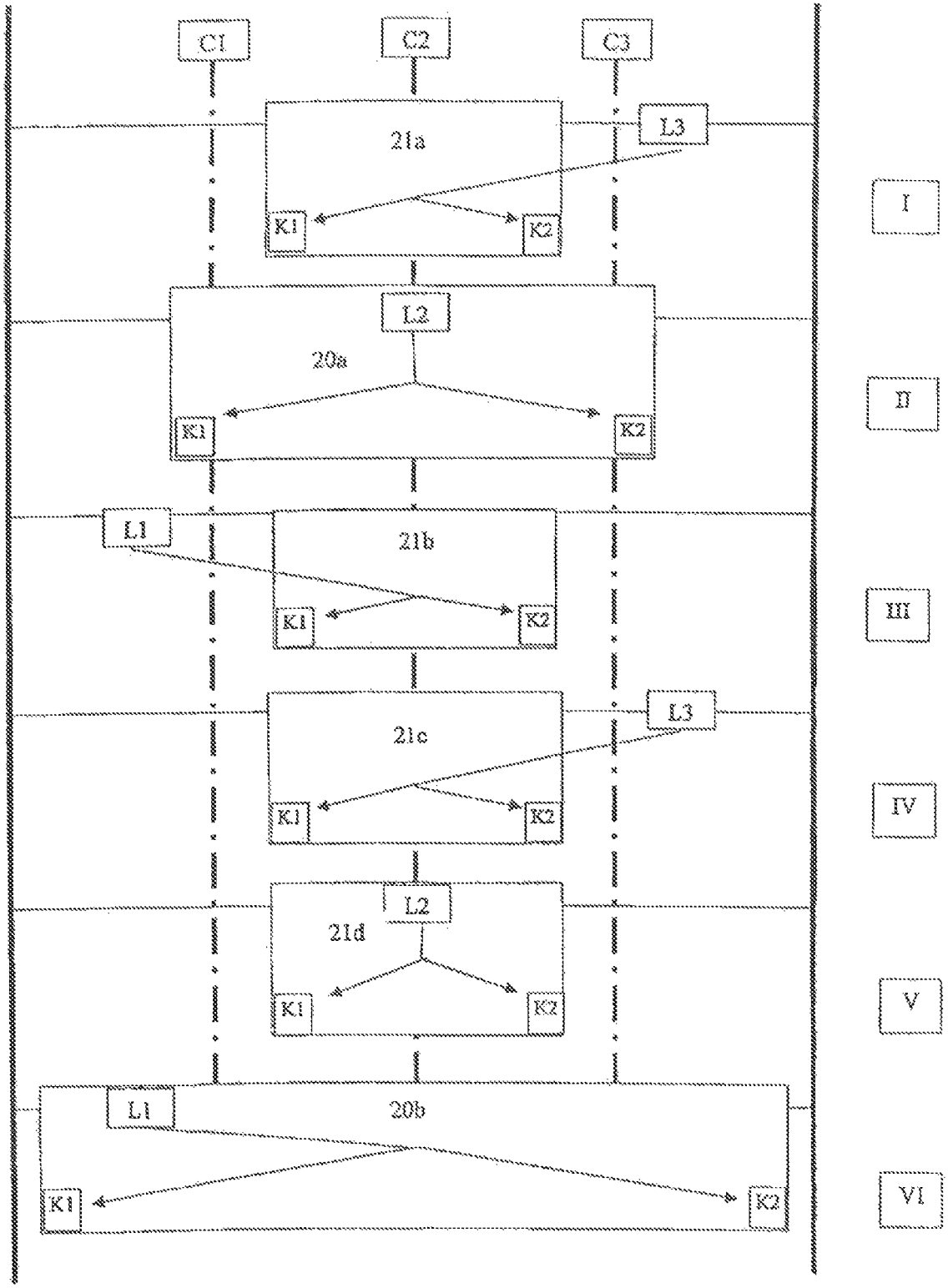
Fig 4 Prior Art
FIGS. 4 and 5 show what can be accomplished by the prior art technique and the method according to the invention, respectively.
Figure 5:
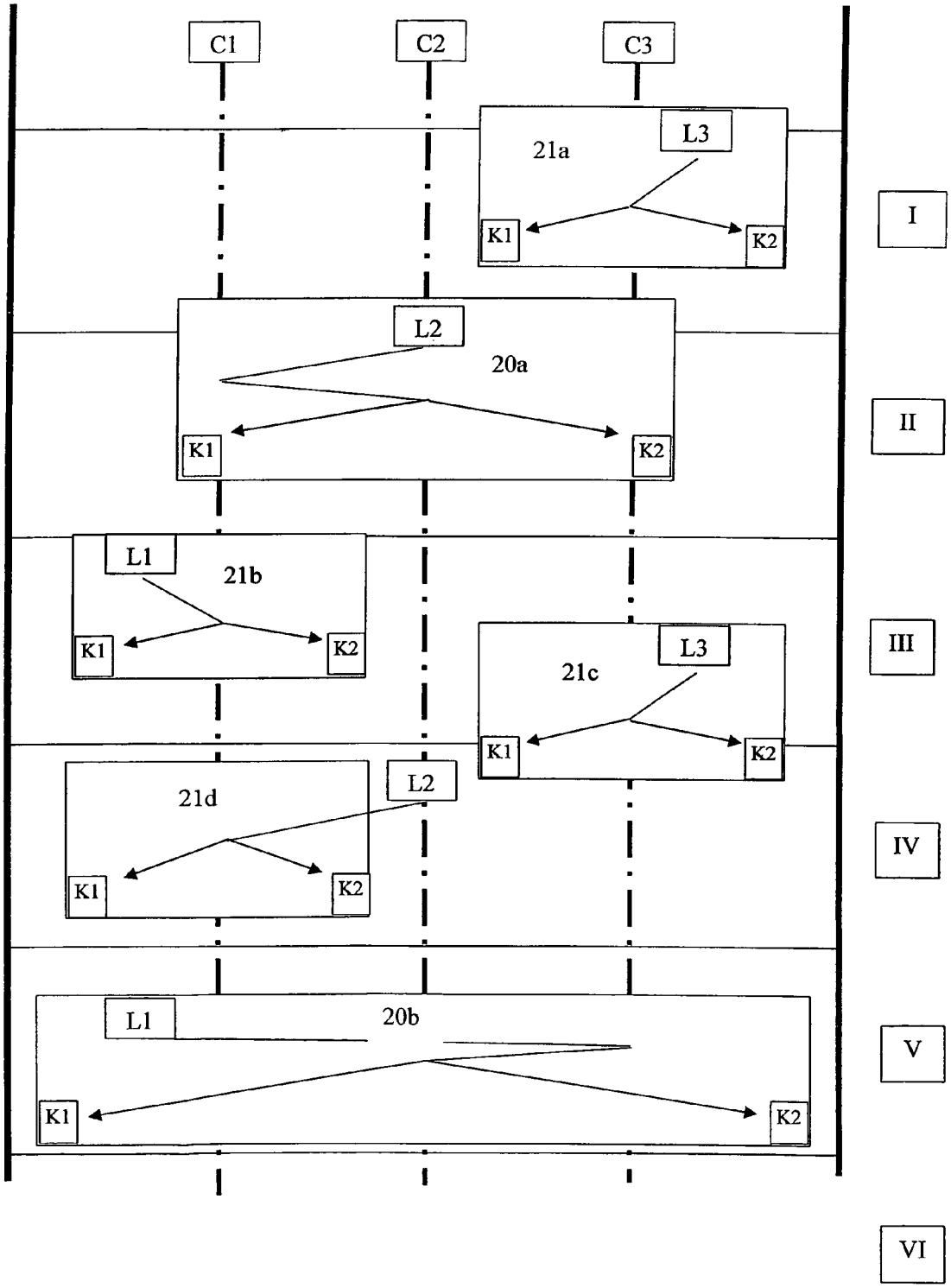

FIGS. 4 and 5 illustrate the performance of the method according to the invention. When a batch of pieces of cloth of mixed size is concerned and one has not measured the individual pieces of cloth in advance or will not, at a later stage, measure the individual pieces of cloth, use of the prior art means that the spreader clamps always travel inwards and spread the piece of cloth about the middle of the apparatus corresponding to the centreline C2. In FIG. 4, in time phases II and VI, a relatively wide piece of cloth 20*a* and 20*b*, respectively, is transferred, while in time phase I and III-V, relatively small-sized pieces of cloth 21*a*-21*b* are transferred. The arrows shown in FIG. 4 illustrate the movement of the spreader clamps. For instance the spreader clamps in II receive the piece of cloth 20*a* from the charger station L2 and immediately spreads out the piece of cloth. In phase III, a piece of cloth 21*b* arrives at he charger station L1, but according to the prior art the spreader clamps transfer the piece of cloth about the centreline C2.

In FIG. 5, time phases I-V correspond to the time phases shown by I-VI in FIG. 4. The saving of time which is accomplished in accordance with the invention is due to the fact that a small-sized piece of cloth is first conveyed to the centreline for small-sized pieces of cloth C3 or C1. For instance, it will appear that the piece of cloth 21*b* which is delivered about the centreline C2 in FIG. 4 is delivered about the centreline C1 in FIG. 5. Apart from the saving appearing from the following explanation of phases III and IV in FIG. 5, it will be understood that the piece of cloth 21*b* in FIG. 5 could leave space for another, small-sized piece of cloth during the same time phase I.

In II in FIG. 5, a new piece of cloth 20*a* arrives at the charger station 2, and according to the invention the spreader clamps will first travel to the centreline C1 and seek to spread out the piece of cloth, but as, in so doing, it turns out that the piece of cloth is a large-sized piece of cloth, the spreader clamps K1 and K2 travel to the centreline C2 where the piece of cloth is spread out. Here one might believe that such relatively longer travelling time of the spreader clamps would delay the process, but, as will appear from FIG. 4 in III and IV, the spreader clamps also travel a fairly long distance, which cancel out each other. The greatest gain obtained by the invention is the more efficient utilisation of the roller paths as will appear from phases III and IV in FIG. 5. As will later be explained in the context of FIGS. 7 and 8, particular advantages are obtained when three spreader clamps are used.

In FIG. 5, in phase III, a small-sized piece of cloth arrives at the charger station L1, and the pieces of cloth are immediately spread out and transferred, but before that process has ended, another small-sized piece of cloth is already received at the charger station L3, and so it goes on with dense packing of the small-sized pieces of cloth until a piece of cloth 20*b* appears. In a worst-case scenario it arrives at charger station L1, and the clamps will therefore immediately travel to C3 in an attempt to accomplish the dense packing just mentioned. There, it is ascertained that a large-sized piece of cloth is concerned, following which the clamps travel to C2 and spread out the piece of cloth. As mentioned above, such additional travelling is of less consequence compared to the advantage obtained by the improved loading of the roller path represented by centrelines C1-C3.

For comparison with FIG. 4, it will appear that, by the method according to the invention, the same number of pieces of cloth could be transferred by means of one less time phase.

Figure 6:
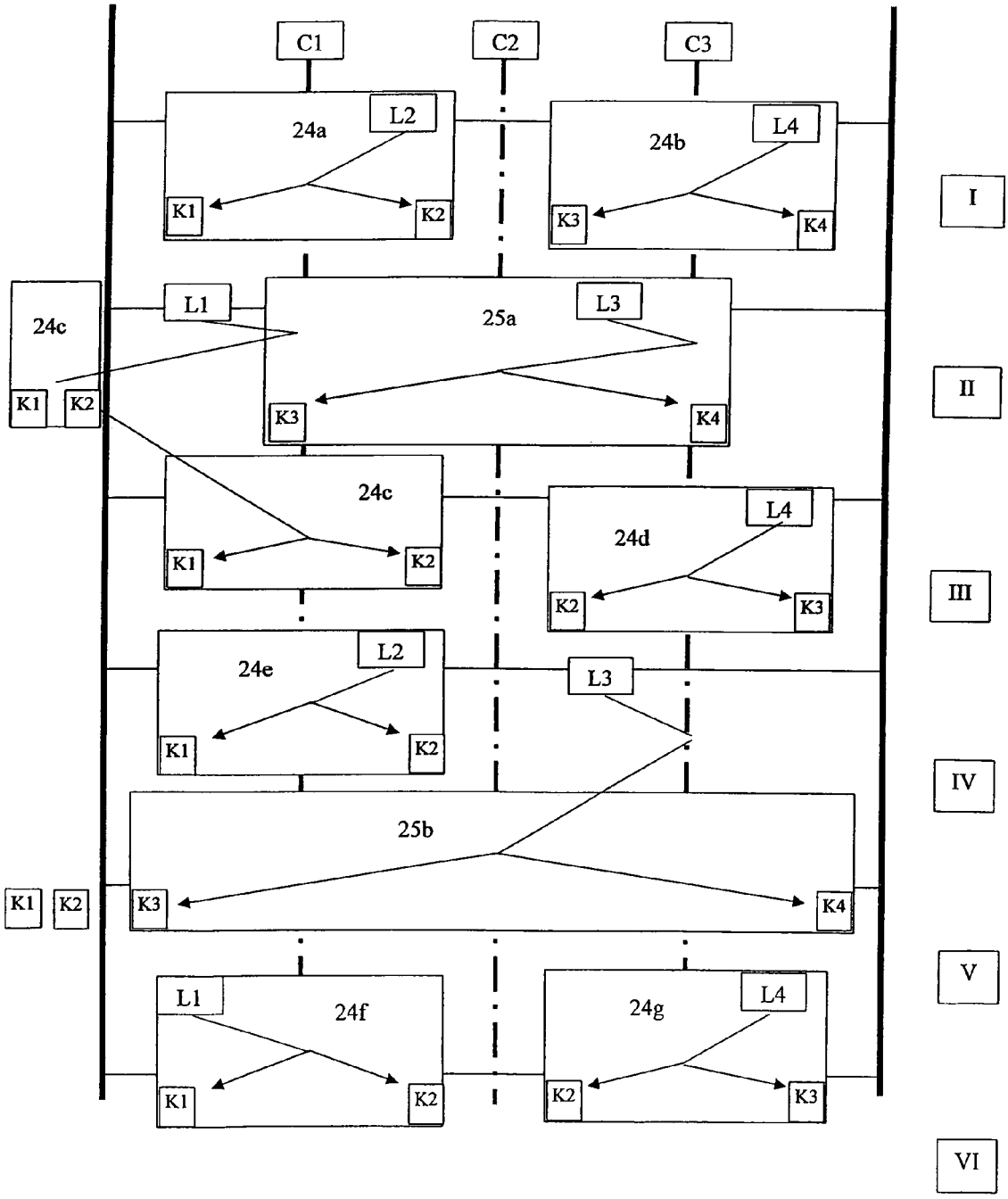
FIG. 6 shows an example of exercising the method by means of an apparatus featuring three charger stations and four spreader clamps.

Above, the method was explained in the context of an apparatus with two spreader clamps and three charger stations. With reference to FIG. 6, it will be explained how the invention works with four charger stations L1-L4 and two sets of spreader clamps K1-K4. The centreline C2 continues to represent the centreline for relatively large-sized pieces of cloth, while centrelines C1 and C3 represent the centrelines for relatively small-sized pieces of cloth. It is still assumed that the operator has assessed that the batch of pieces of cloth predominantly contains small-sized pieces of cloth.

In time phase I, pieces of cloth arrive at the spreader clamps K1-K4 which, according to the invention, in time phase II centres on each their centreline C1, C3 for small-sized pieces of cloth. As long as only small-sized pieces of cloth arrive, it is possible to obtain, by that apparatus, the densest possible packing and hence the most efficient utilisation of a subsequent rotary ironer.

In time phase II in FIG. 6, a small-sized piece of cloth 24*c* arrives at a charger station L1 and a large-sized piece of cloth 25*a* arrives at charger station L3. During the spreading out it is ascertained that the piece of cloth 25*a* cannot be spread out, and therefore the spreader clamps K1 and K2 with the piece of cloth 24*c* are parked to the left of the apparatus, while the piece of cloth 25*a* is spread out and delivered about the centreline C2.

In time phases III and IV the piece of cloth 24*c* and the new pieces of cloth 24*d* and 24*e* are delivered, and it is assumed in FIG. 6 that a large-sized piece of cloth 25*b* will arrive at the charger station L3 at such time that it is ascertained that this is a large-sized piece of cloth before a new piece of cloth arrives at the clamps K1 and K2. Therefore the latter clamps are put on hold until the large-sized piece of cloth 25*b* has been delivered, following which the process as described above continues at V. The savings obtained the apparatus explained in the context of FIG. 6 is thus again the more effective utilisation of the roller paths simultaneously with the apparatus being capable of accepting that, at times, a large-sized piece of cloth will arrive.

Figure 7:
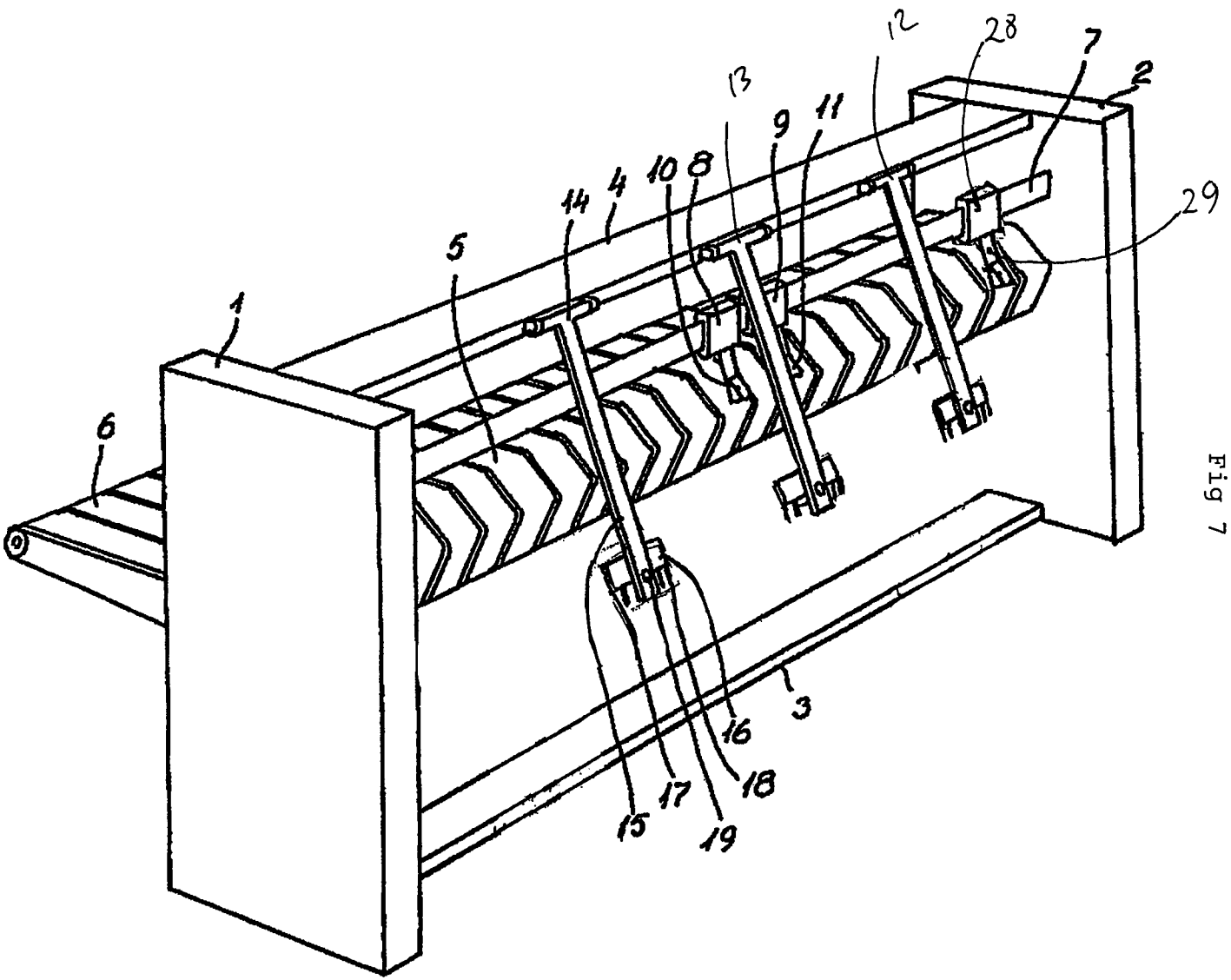
FIG. 7 shows an example of an apparatus comprising three charger stations and three spreader clamps that are suitable for use in the context of the invention; while FIG. 8 schematically shows how the apparatus shown in FIG. 7 works.

The invention is also particularly suitable for use in the context of an apparatus where three spreader clamps are provided. FIG. 7 shows an example of such apparatus, where the three charger stations 12, 13 and 14 are shown that are also found in FIG. 1, but wherein a further carriage 28 with associated spreader clamp 29 is also provided. According to the invention, the three spreader clamps 10, 11, 29 are driven such that a pair of active spreader clamps comprise the middle spreader clamp 11 and the one of the outer spreader clamps 10 or 29 which is closest to the charger station 12, 13 or 14 from which a piece of cloth is to be received. This mode of operation will be explained in further detail with reference to FIG. 6.

Figure 8:
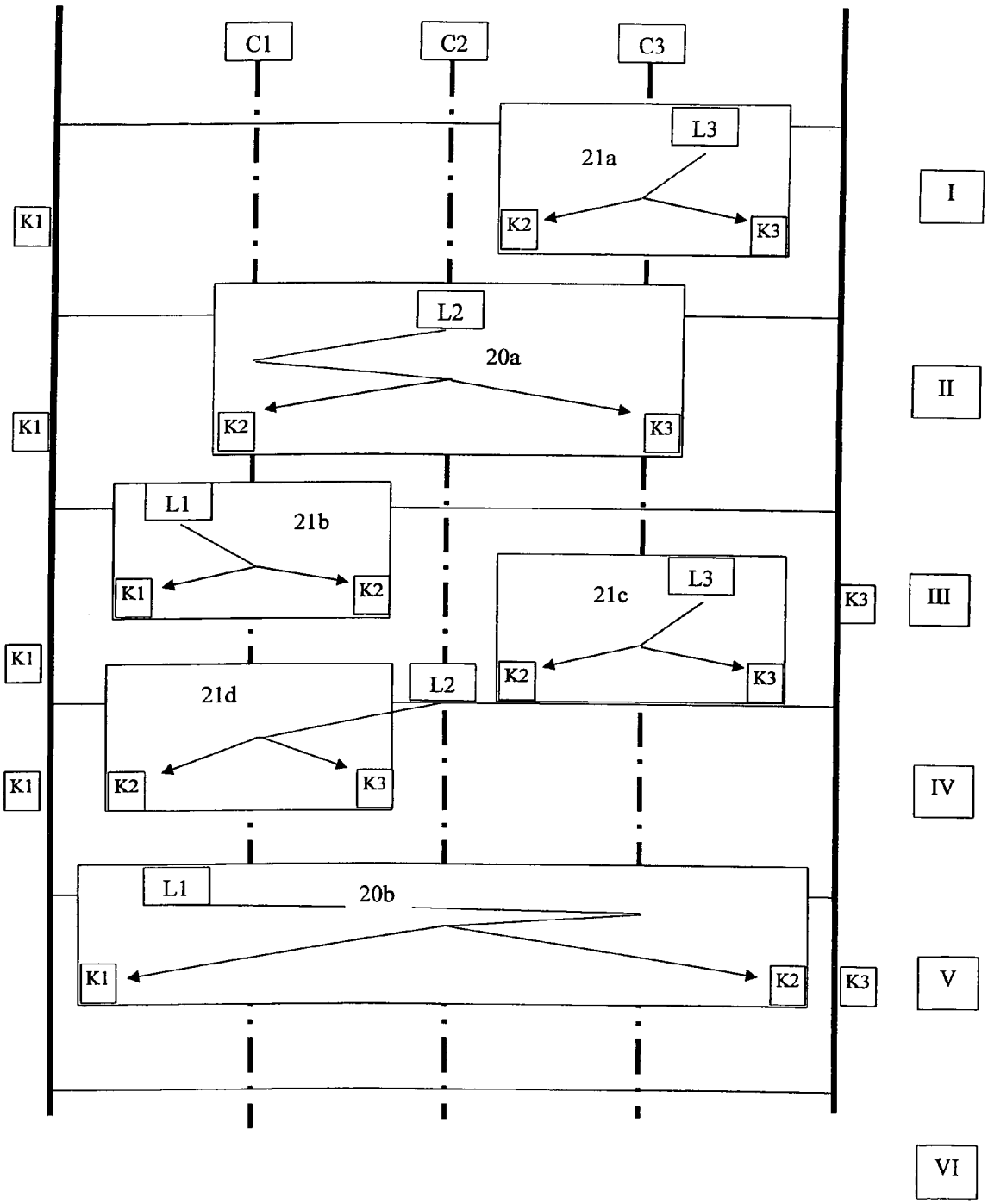

Like in the above disclosures, FIG. 8 features charger stations L1-L3, but with the difference that now three spreader clamps K1-K3 are provided. Moreover, centrelines C1 and C3 are shown that correspond to relatively small-sized pieces of cloth, and a centreline C2 that corresponds to relatively large-sized pieces of cloth. In FIG. 8 it is assumed that, in accordance with the invention, the operator has set the apparatus to the current batch of pieces of cloth being predominantly small-sized pieces of cloth.

It was explained above how the invention entails major advantages due to the more efficient utilisation of the roller paths and compared to this any additional travelling time for the spreader clamps has been less consequential. However, in the embodiment shown in FIGS. 7 and 8, a reduction is obtained in the travelling time of the clamps, while simultaneously the efficient utilisation as explained above of the roller paths is achieved. The latter embodiment thus represents the best possible improvement over the prior art.

FIG. 8 is comparable to FIG. 5 where time phases I and II are the same. It applies both to utilisation of the roller paths and the distance of movement traveled by the clamps. In III and IV in FIGS. 5 and 8, considerable savings now occur in the travelling time of the clamps by the embodiment shown in FIG. 8. Clamp K1 which was passive during time phases I and II now along with clamp K2 takes over a piece of cloth 21*b*, while simultaneously clamp K3 is parked to the right in the figure. Immediately after the piece of cloth 21*b* has been delivered, clamp K2 travels to L3 and the travelling distance being shorter than the corresponding travelling distance in FIG. 5 for K1, the piece of cloth can be received and spread more quickly. The clamp K3 enters into operation due to the piece of cloth 21*c* being received at the outermost charger station L3.

Then a piece of cloth arrives at the charger station L2 and according to the invention the clamps in operation are therefore to continue their operation to the effect that clamp K1 will remain parked to the left in the figure. The minute a piece of cloth arrives at charger station L1 in time phase K1, clamp K1 enters into operation, while K3 is parked to the right in the figure. According to the invention, clamps K1 and K2 will first attempt to deliver the piece of cloth 10*b* at the centreline C3 with a view to packing the small-sized pieces of cloth as densely as possible, but, if, in time phase V, it turns out that 10b is a large-size piece of cloth, the clamps travel towards the middle and spread out the piece of cloth as will appear during V.

The invention claimed is:

1. A method for operating at least two spreader clamps for receiving and holding in pairs pieces of cloth from one or more charger stations and for spreading out the pieces of cloth before they are delivered to a conveyor, which conveyor has a first centerline for receiving large-sized pieces of cloth and at least two outer centerlines arranged on either side of said first centerline for receiving small-sized pieces of cloth, the method comprising selecting for a batch of pieces of cloth whether the at least two spreader clamps first spread a piece of cloth about an outer centerline for small-sized pieces of cloth or about the first centerline for large-sized pieces of cloth, feeding a piece of cloth to the pair of the at least two spreader clamps, moving the at least two spreader clamps so as to be situated in relation to the centerline selected, initiating movement of the spreader clamps to either side of the centerline selected to spread the piece of cloth about the selected centerline before the size of piece of cloth is detected and ascertaining during the spreading about the centerline selected if the piece of cloth being spread is a large-sized piece or a small-sized piece, wherein if an outer centerline is selected and it is ascertained that a piece is a large-sized piece of cloth, moving the at least two spreader clamps so that the piece of cloth is spread about said first centerline and if the first centerline is selected and it is ascertained that the piece of cloth is a small-sized piece of cloth, moving the at least two spreader clamps so that the piece of cloth is spread about one of said outer centerlines.

2. The method according to claim 1, wherein the at least two spreader clamps are situated essentially symmetrically in relation to the centerline selected and the spreader clamps are subsequently spread to either side of said centerline.

3. The method of claim 1, wherein the size of the piece of cloth is ascertained during spreading by measuring a force transmitted to the spreader clamps by drive means for spreading the at least two spreader clamps.

4. The method according to claim 3, wherein the force is measured as a function of power consumption of a drive engine of the drive means.

5. The method according to claim 3, wherein the force is measured by means of a pressure cylinder arranged between a spreader clamp and the drive means.

6. The method according to claim 1, wherein three spreader clamps are used.

7. The method according to claim 6, wherein a third middle spreader damp is located between the at least two spreader clamps and the pair of spreader clamps for receiving and holding a piece of cloth is the middle spreader and the one of the two that is located closest to the charger station from which the piece of cloth is to be received.

* * * * *